United States Patent [19]

Marrs

[11] 3,968,770

[45] July 13, 1976

[54] TINTING FLUID DISTRIBUTING APPARATUS FOR WEB FED PRINTING PRESS

[75] Inventor: Robert G. Marrs, Emporia, Kans.

[73] Assignee: Didde-Glaser, Inc., Emporia, Kans.

[22] Filed: July 3, 1974

[21] Appl. No.: 485,443

[52] U.S. Cl. ..... 118/227; 118/259; 118/262; 101/366

[51] Int. Cl.[2] ..... B05C 1/08

[58] Field of Search ..... 101/366; 118/262, 46, 118/227, 259

[56] References Cited

UNITED STATES PATENTS

| | | | |
|---|---|---|---|
| 2,205,201 | 6/1940 | Iwaniw | 118/46 |
| 2,293,691 | 8/1942 | Harrigan | 118/262 X |
| 2,730,989 | 1/1956 | Pearce | 118/259 X |
| 3,018,757 | 1/1962 | Loppnow | 118/262 |
| 3,205,816 | 9/1965 | Heimlicher | 101/366 |
| 3,405,006 | 10/1968 | Follrath | 118/262 X |

*Primary Examiner*—John P. McIntosh
*Attorney, Agent, or Firm*—Schmidt, Johnson, Hovey & Williams

[57] ABSTRACT

A simplified press mounted, web-driven paper tinting unit especially useful for high speed presses and having low pressure, substantially clog-free, infinitely manually adjustable tinting fluid dispensing heads positioned proximal to underlying, freely rotatable tinting fluid-receiving rolls forming a part of the unit. The heads are preferably rotatable members having radially offset fluid delivery tubes and selectively movable betwen positions where all of the fluid from the latter directly impinges on the receiving rolls, to positions where at least a part of such fluid flows past the rolls for cyclic re-collection and reuse. In this manner, delivery of the tinting fluid to the web can be easily varied during tinting operations as desired without the need of flow-restricting metering valves or the like which are prone to clogging. The anti-clogging properties of the heads are enhanced by provision of relatively large diameter fluid conduits coupling a low pressure tinting fluid pump to the heads, which permits substantially unrestricted fluid flow to the latter under relatively low pressure. Coloration control is also facilitated through the use of flexible, synthetic resin, plate-like metering members positioned in spanning, tangential engagement with the tinting fluid-receiving rolls at points thereon forward of the areas where tinting fluid impinges. The metering members are operable to automatically yield in response to variable hydraulic pressures directed thereagainst from the accumulated tinting fluid on the rotating reception rolls to permit variable regulation of the quantity of tinting fluid ultimately applied to the moving web.

8 Claims, 8 Drawing Figures

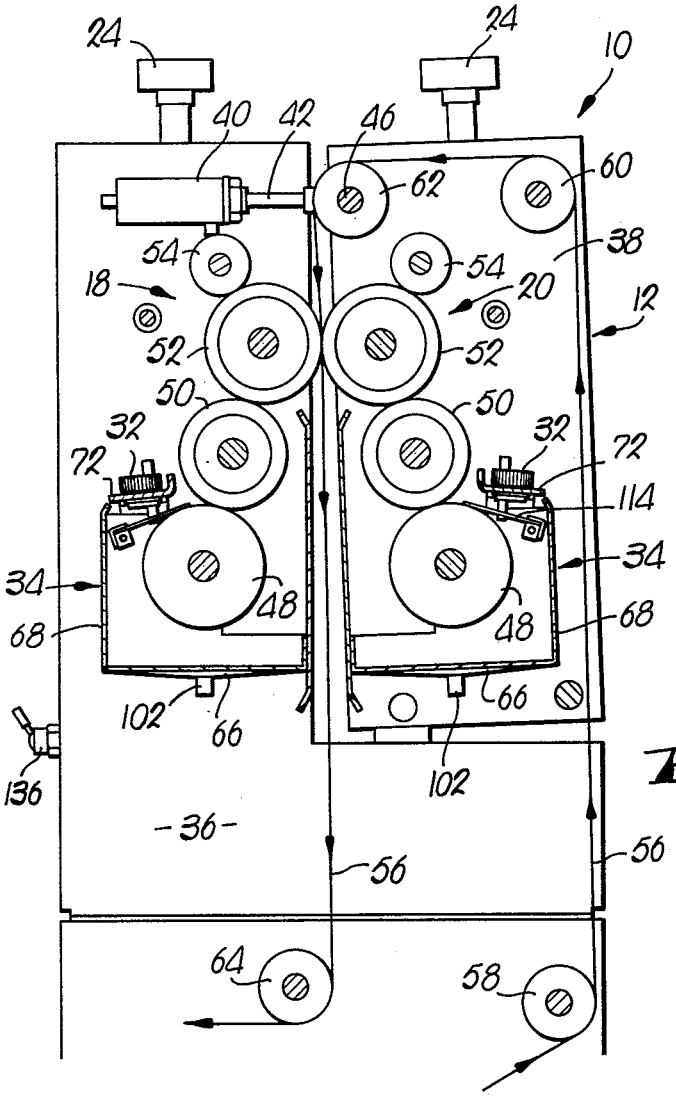
Fig.3.
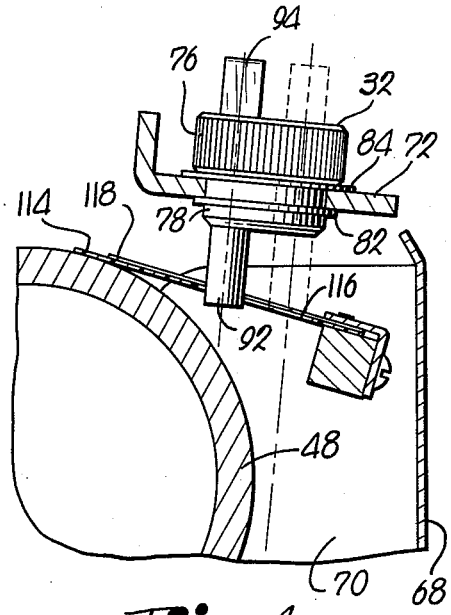
Fig.4.
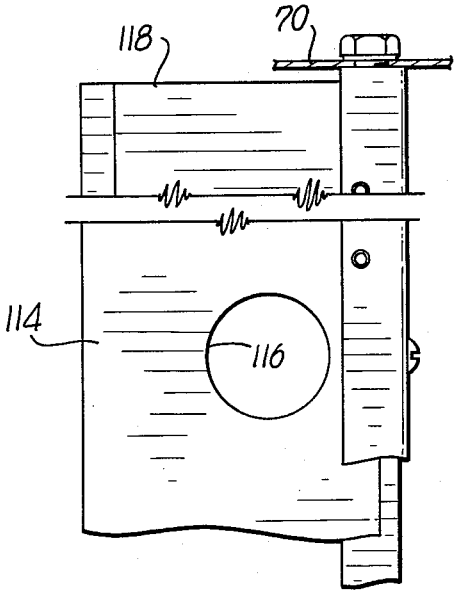
Fig.5.
Fig.8.
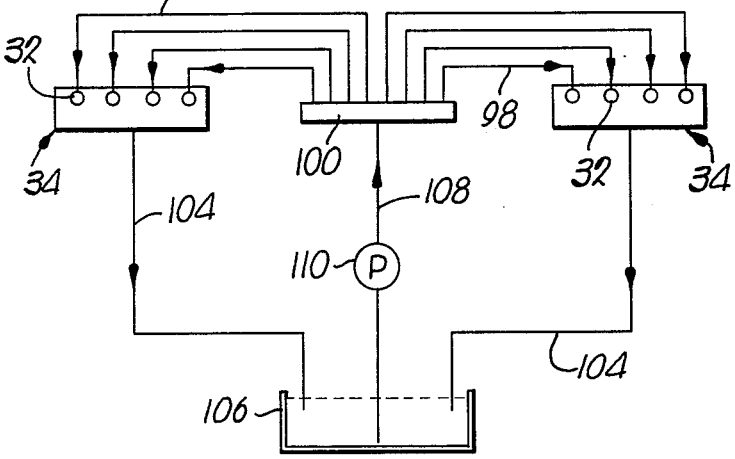

TINTING FLUID DISTRIBUTING APPARATUS FOR WEB FED PRINTING PRESS

This invention relates to efficient, high-speed tinting units especially adapted for use with in-line, web-fed printing presses. More particularly, it is concerned with such tinting units having as an adjunct thereof an easily adjustable tinting fluid dispensing system which eliminates the need of flow-restricting needle valves or the like which inherently exhibit a tendency to clog during tinting operations. In this manner, accurate and uniform web coloration is accomplished and the unit is capable of manual adjustment while in use to provide precise coloration control without fear of clogging of the fluid delivery system.

In recent years, the demand for colored backgrounds on printed materials as opposed to simply a basic white background has increased dramatically. Accordingly, it has been necessary for the printer to maintain a large inventory of colored paper stock in various shades in order to satisfy the diverse demands of his customers. This in itself is less than desirable because of the costs associated with such large inventories and the need for frequent reordering of the colored stock. Perhaps of even greater importance is the fact that colored stock is necessarily more expensive than plain white stock and, in some instances, the cost may even by prohibitive. Moreover, the printer is always at the mercy of his supplier, leading to annoying and perhaps costly delays should the supplier be unable to fill the printer's order for specific colors, paper types and roll widths in a timely manner.

Concurrent with the rising demand for colored paper backgrounds has been increasing use by the printing industry of so-called "in-line" web-fed printing presses which utilize paper stock in roll form. Such presses are adapted to continually advance a paper web through various stations where separate operations such as printing, perforating and sheeting are performed. Manifestly, when the size and bulk of such rolls are considered, it becomes clear that the storage, handling and cost problems alluded to above are greatly magnified. In order to prepare such a press for a new job requiring a different color paper than that previously employed, it has been necessary to go through the cumbersome steps of removing the old roll, placing it in storage, removing a new roll from storage, and installing the latter on the press. When this process is repeated many times over in a single day of operation, it is apparent that these problems are even further pronounced.

One response to the problems referred to above is embodied in a prior tinting unit provided with two separate, opposed, freely rotatable roll trains journaled within an overall frame structure to cooperatively present at the upper end thereof a coloration nip for the passage of a continuous web therebetween. A tinting fluid-receiving roll is positioned at the lowermost end of each roll train with a plurality of horizontally arranged tinting fluid nozzles disposed proximately thereto for depositing a stream of tinting fluid thereon. During tinting operations as a web of paper material is advanced through the coloration nip and tinting fluid is simultaneously deposited on the reception rolls therefor, the rolls in the respective trains are caused to rotate and tinting fluid is thus transferred to applicator rolls at the uppermost ends of the trains and thence to the web itself. Precise coloration control is obtained through the use of manually adjustable metering valves positioned in flow-restricting relationship in the supply conduits for the respective fluid nozzles. These valves can be selectively manipulated by the operator in order to vary the volumes of tinting fluid applied to the reception rolls therefor. Moreover, additional tint control is obtained through the use of flexible, synthetic resin, plate-like metering members in spanning engagement with the respective reception rolls which are operable to automatically regulate the amounts of tinting fluid applied to the moving web.

In practice, excellent overall web-tinting results have been obtained using the above-described tinting unit. However, in some instances the small orifice metering valves thereof have become clogged with paper lint or loose fibers from the moving web which find their way into the recirculating tinting fluid supply. This clogging problem is believed to stem from the use of flow-restricting, selectively adjustable needle valves in the tinting unit as a means for partially controlling web coloration. As can be appreciated, this problem can become a serous drawback in highspeed tinting operations wherein the web is moving at a rate of 1000 feet per minute or more.

It will also be readily apparent that any improved tinting unit utilizing a tinting fluid dispensing system which is substantially free of clogging problems must also be capable of accurately and uniformly tinting a moving web under all varying web speeds and degrees of coloration encountered in everyday use. Thus, such an improved unit must not suffer from a concomitant lessening of the desirable operational characteristics of the former device in an attempt to overcome the clogging problem.

Hence, there is a need in the art for a press mounted, efficient, high-speed, web-tinting unit for use with in-line web-fed printing equipment which embodies easily and quickly adjustable tinting fluid dispensing system free of flow-restricting metering valves or the like heretofore used and which is capable of accurately and uniformly tinting webs of different widths moving through the press at varying web speeds and coloration conditions.

It is therefore the most important object of the present invention to provide a tinting unit especially adapted to be mounted directly on a high-speed, in-line, web-fed printing press and which incorporates a tinting fluid-dispensing system having fully adjustable fluid delivery characteristics but is substantially immune to clogging tendencies sometimes found in units having fluid-dispensing systems controlled by flow-restricting metering valves or the like.

As a corollary to the foregoing, it is an important aim of the invention to provide such a dispensing system wherein tinting fluid flow is easily and quickly manually adjustable during tinting operations in order to precisely control the amount of fluid metered to the rollers without the necessity of shutdown. In this connection, the invention contemplates the use of a plurality of shiftable tinting fluid-dispensing heads which are movable between a non-tinting position where substantially all of the fluid coming from the heads is directed away from the underlying reception roll therefor, to tinting positions where at least a portion of the fluid impinges on the reception roll.

Another object of the invention is to provide an infinitely adjustable, rotatable dispensing head having a radially offset delivery tube for dispensing tinting fluid onto the tinting fluid-receiving rolls, in conjunction with a low-pressure pump and relatively large diameter fluid conduits interconnecting the pump and heads. In this manner, substantially unrestricted flow of tinting fluid to the heads is permitted without the need of metering valves or the like having a tendency to clog with extended use.

Yet another object of the present invention is to provide a tinting unit capable of tinting one side or both faces of a web passing therethrough by virtue of the provision of two separate, opposed, freely rotatable roll trains journaled within upstanding frame structure to cooperatively present at the upper end thereof a coloration nip for the passage of a continuous web therebetween. In particular, each roll train preferably comprises a lowermost tinting fluid-receiving roll, an intermediate transfer roll, and an uppermost applicator roll, all of the rolls in each train being in transverse, tangential, fluid-transfer engagement.

A still further object of the invention is to provide a tinting unit including a flexible, synthetic resin, plate-like fluid metering member positioned in spanning, tangential, tensioned engagement with the respective tinting fluid-receiving rolls of each roll train in order to automatically meter the amount of tinting fluid transferred therepast to thus control the transverse color uniformity as well as the color density ultimately applied to the moving web. The metering members are operable to automatically yield in response to variable hydraulic pressures directed thereagainst from the accumulated tinting fluid deposited on the rotating reception rolls by the dispensing heads.

In the drawings:

FIG. 3 is a vertical sectional view taken along line 3—3 of FIG. 2 and illustrating the use of the present tinting unit during coloration of a moving web;

FIG. 4 is a fragmentary, enlarged view in vertical section illustrating in detail the relationship between the tinting fluid-dispensing heads, plate-like metering member, and underlying tinting fluid-receiving roll;

FIG. 5 is a fragmentary, top plan view of a flexible plate-like metering member adapted to be positioned in spanning engagement with each of the respective tinting fluid reception rolls of the separate roll trains;

FIG. 8 is a schematic representation of the tinting fluid dispensing and collection apparatus utilized in the tinting unit of the invention.

Figure 1:
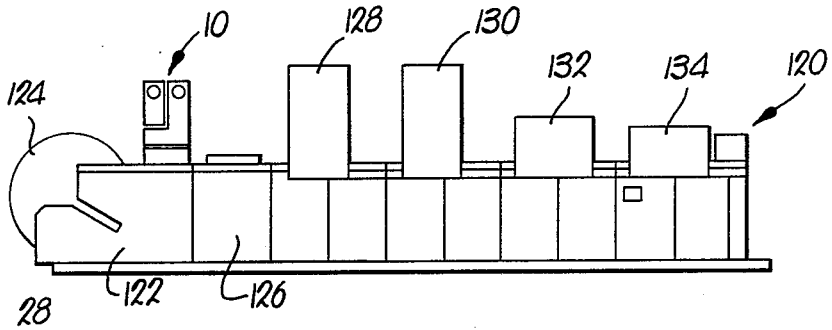
FIG. 1 is a side elevational view of a multi-station, in-line, web-fed printing press having a tinting unit in accordance with the present invention mounted thereon.
Figure 2:
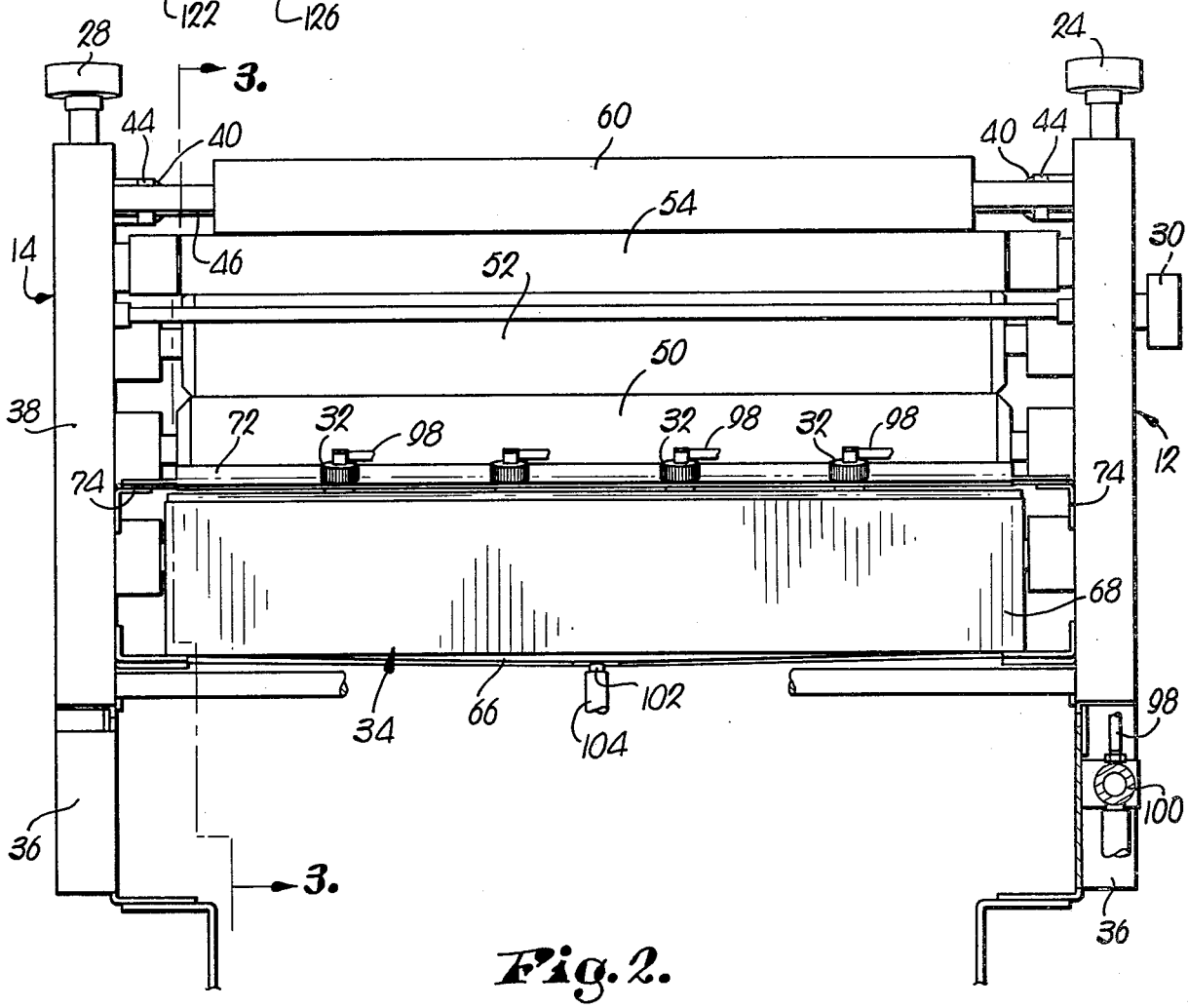
FIG. 2 is a front elevational view of a tinting unit in accordance with the present invention, showing the roll trains and fluid-dispensing heads associated therewith and the underlying tray collection structure.

The tinting unit generally referred to by the numeral 10 in FIGS. 1 and 2 is adapted to be installed on a high-speed, web-fed printing press directly ahead of the first printing or processing station thereof for continuously tinting a web of paper or other material as it advances through the unit. Broadly, unit 10 includes a pair of spaced, opposed, upstanding segmented supports 12 and 14 having a plurality of rolls journaled for free rotation between supports 12 and 14 and defining two separate, identical roll trains 18 and 20 to be described in detail hereinafter. Conventional adjustment knobs 24, 28 and 30 are provided for adjusting the relative orientation and interengagement of the rolls in the respective trains 18 and 20. Two sets of spaced, horizontally arranged fluid-dispensing heads 32 are also provided in conjunction with separate, underlying, removably mounted tray structures 34 serving to collect any excess tinting fluid from heads 32.

It will be seen from a study of FIG. 3 that each of the supports 12 and 14 comprise a first, generally L-shaped stationary segment 36, and a second, pivotally mounted, movable, generally rectangular segment 38. Selective, reciprocal, pivoting movement of segment 38 is obtained through the use of a pair of pneumatically actuated piston and cylinder assemblies 40 having connecting rods 42 extending therefrom which are, in turn, attached by means of annular collars 44 to opposed, stationary shafts 46 extending from the separate movable segments 38.

As described, identical roll trains 18 and 20 are journaled between the opposed segments 36 and 38 of the respective upright supports 12 and 14. Each roll train includes a lowermost metallic tinting fluid-receiving roll 48, an intermediate resilient transfer roll 50, and an upper resilient applicator roll 52. In addition, eccentrically mounted, resilient adjustment rolls 54 are provided for the purpose of spreading or smoothing the ink or tinting fluid before it is applied to the web.

As best shown in FIG. 3, the roll trains 18 and 20 are configured and arranged such that when the pivotally mounted segments 38 are moved to the left, a coloration nip is defined between the respective applicator rolls 52 for the passage of a web of paper 56 therethrough. In this connection, a plurality of idler rolls 58, 60, 62 and 64 are also journaled between upright supports 12 and 14 for defining a path for web 56 through unit 10.

Separate identical collection tray structures 34 are disposed in generally underlying relationship to respective tinting fluid-receiving rolls 48 and include a basin portion 66, a generally vertical, horizontally extending forward splash wall 68, spaced sidewalls 70, and a short, vertical back wall (not shown). (In order to facilitate cleaning and servicing of the roll trains, collection trays 34 are removably mounted for permitting the latter to be quickly and easily removed for maintainence purposes and the like.)

Figure 6:
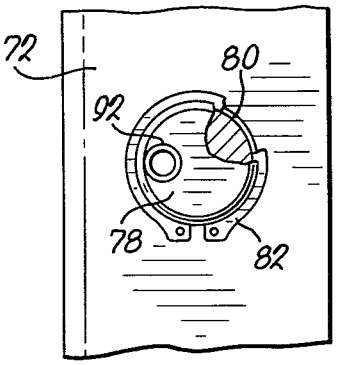
FIG. 6 is a fragmentary, partially cutaway bottom view of a tinting fluid dispensing head in accordance with the invention, shown mounted in the support structure therefor.

A plurality of horizontally arranged tinting fluid-dispensing heads 32 are installed along an upper, angularly disposed apertured metallic support 72 which is in turn attached at the respective ends thereof to L-shaped brackets 74 which are affixed to supports 12 and 14. In this connection, each head 32 (see FIGS. 6 and 7) includes a radially enlarged, generally cylindrical uppermost knurled block portion 76, with an integral, concentric, depending extension 78 of lesser diameter. Extension 78 includes a lower, annular, circumferentially extending groove 80 which is adapted to receive a retainer ring 82 for the purpose of rotatably securing each head 32 within a corresponding apertured support 72. In this respect, a second annular tension ring 84 is positioned adjacent the underside of each of the block portions 76 in engagement with the upper surface of support 72 in order to aid in tensionably holding the respective heads 32 in desired operative position thereof.

Each head 32 also includes an elongated, stepped bore 86 therethrough which is positioned in radially offset relationship from the geometric center of the head. The bores 86 are threaded at the lowermost ends thereof as at 88 and each has a slightly radially enlarged, uppermost portion 90. An elongated hollow delivery tube 92 is threadably mounted within the lowermost portion 88 of each bore 86, while a separate elbow 94 having a bore 95 therethrough is secured within the uppermost portion 90 of a respective bore 86. An annular synthetic resin bushing 96 is also positioned in circumscribing relationship to the depending leg of elbow 94 for the purpose of providing a secure engagement between the sidewalls of bore 86 and elbow 95.

Figure 7:
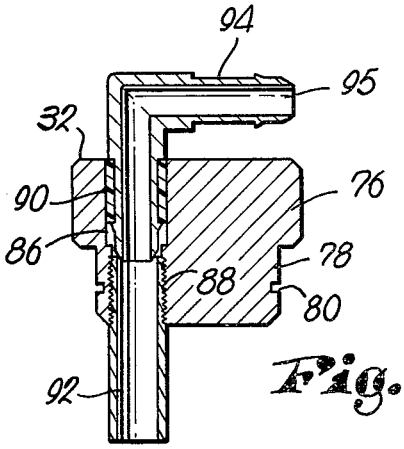
FIG. 7 is an enlarged view in vertical section illustrating in detail the construction of the tinting fluid-dispensing heads of the invention.

Referring specifically to FIG. 7, it will be seen that the respective bores of elbow 94 and delivery tube 92 are in communication and are of substantially equal diameter. It will thus be apreciated that tinting fluid directed to each head 32 flows evenly therethrough and is in no way constricted as by needle valves or other metering devices.

Separate tinting fluid delivery hoses 98 of substantially equal or greater diameter than that of bore 95 of each elbow 94 are connected to the transverse arms of the latter as illustrated in FIG. 2. The separate hoses 98 extend to a common tubular manifold 100 positioned exteriorly of segment 36 of support 12. Additionally, a delivery pipe 102 depends from each basin 66 and communicates with the interior thereof in order to provide a return for excess tinting fluid delivered from heads 32. Separate identical stretches of flexible tubing 104 extend between pipes 102 and a common supply 106 of tinting fluid (shown schematically in FIG. 8).

Referring again to FIG. 4, it will be seen that each of the heads 32 is axially rotatable within elongated support 72. This axial rotation provides an infinite, selective, manual adjustment for web coloration by unit 10. In particular, when the heads 32 are in the position shown in full lines in FIG. 4, substantially all of the tinting fluid dispensed therefrom impinges upon underlying reception roll 48. However, when a corresponding head 32 is turned 180° to the position shown in phantom in FIG. 4, substantially all of such tinting fluid flows past the reception roll 48 without impinging thereon. Thus, it is possible to selectively apply tinting fluid to the reception rolls therefor by the simple expedient of manually adjusting the respective heads 32. Moreover, this control is facilitated by virtue of the fact that the heads 32 are each individually infinitely adjustable between the extreme positions depicted in FIG. 4. Thus, if it is desirable to apply only a small percentage of fluid being delivered to the heads onto the underlying reception rolls 48, it is only necessary to turn the heads to an extent such that the proper amount of tinting fluid impinges on the underlying reception rolls 48.

It is also important to note that the adjustable coloration control provided in unit 10 by virtue of rotatable heads 32 eliminates the need for flow-restricting metering valves or the like which have characterized prior tinting units. Thus, it is only necessary to provide pump and conduit structure for delivering an even volume of tinting fluid at all times to the respective heads 32, whereupon web coloration can be precisely controlled simply by adjusting the heads 32 relative to the reception rolls 48.

The overall tinting fluid dispensing and collection system is shown schematically in FIG. 8. In particular, the system includes a common supply of tinting fluid 106, a common distribution manifold 100, and separate arrays of distribution heads 32 positioned proximal to the reception rolls 48 in each train 18 and 20 as described. A conduit 180 interconnects supply 106 and manifold 100, and has a low-pressure pump 110 interposed therein for the purpose of delivering tinting fluid to the distributors from supply 106. In this connection, it has been found that only relatively low fluid pressures are required, and accordingly, pump 110 need only be capable of developing fluid pressures on the order of 1½ to 2½ pounds per square inch. A plurality of hoses 98 extend between common manifold 100 and the separate dispensing heads 32 to complete the fluid delivery system. Fluid return is provided by means of return conduits 104 which extend between the separate tray structures 34 and supply 106.

In view of the foregoing, it will be apparent that when the respective heads 32 are in the non-tinting disposition thereof (shown in phantom in FIG. 4), tinting fluid will simply be delivered through conduit 108, manifold 100 and supply hoses 98, whereupon the fluid will be dispensed by heads 32. This fluid will then flow past the respective tinting fluid-receiving rolls 48 and be collected in the separate tray structures 34, whereupon it will return through conduits 104 to supply 106. This is of course the "down" mode for unit 10 when no web 56 is being tinted. Similarly, when it is desired to tint a continuous web 56 passing through unit 10, it is only necessary to turn each of the respective heads 32 to effect the desired degree of web coloration.

A flexible, synthetic resin, apertured, plate-like metering member 114 is connected between the sidewalls 70 of tray units 34 and extends into frictional engagement with a respective proximal tinting fluid-receiving roll 48. In this regard, it is to be noted that each member 114 engages a respective roll 48 at a point on the latter between the nip defined by roll 48 and transfer roll 50, and the area on roll 48 where tinting fluid from the heads 32 impinges.

As best seen in FIG. 5, each of the metering members 114 is a relatively thin, synthetic resin panel having a series of spaced circular apertures 116 therein. The latter are dimensioned to receive the extreme end of a corresponding delivery tube 92 and permit rotation thereof with each head 32 during adjustment of the latter. Furthermore, in order to strengthen members 114, separate reinforcement segments 118 of synthetic resin material can be affixed to respective marginal ends thereof.

Unit 10 is also provided with means for adjusting the nip pressures between the various rollers of each respective roll train 18 and 20. For this purpose, knobs 24 and 28–30 are provided on the exterior of supports 12 and 14. Since the constructional details of the adjustment mechanism associated with the respective knobs forms no part of the present invention and conventional structure may be used for the purpose, a detailed discussion thereof is deemed unnecessary.

The above-described tinting unit 10 is especially advantageous when employed in conjunction with a high-speed, in-line, web-fed printing press of the type depicted in FIG. 1 and referred to broadly by the numeral 120. Press 120 in this instance, and for illustrative purposes only, includes a roll stand 122 having a roll of continuous, basic white paper 124 therein. The first station in the press supports tinting unit 10, followed by a tensioning unit 126 serving to keep a proper tension on the web of paper moving through the press. A pair of printing towers 128 and 130 are shown positioned downstream from tensioning unit 126 for printing the tinted web passing therethrough. Press 120 may, for example, be completed by an optional numbering and hole-punching head 132, and cutting or perforating and stacking section 134 forming the terminal end thereof. Through the use of such a press (which in other instances could include other operative units such as additional printing towers or web-processing modules), it is possible to successively tint, print, number, punch, perforate and stack for final shipping from a single unit in a continuous high-speed fashion, all with minimal operator control.

After unit 10 is positioned on an in-line web-fed press 120 in the disposition shown, the following steps are sequentially taken in order to initiate tinting operations. First, the respective segments 36 and 38 of the upright supports 12 and 14 are separated by means of pneumatic piston assembly 40. For this purpose, toggle switch 136 is shifted to activate assembly 40 and permit pressurized air to enter the piston chamber thereof to effect opening of the respective segments 36 and 38.

The next step involves threading of a web of paper material 56 through unit 10 and specifically about the idler rolls 58, 60, 62 and 64 which define a tinting path through the unit. Toggle switch 136 is subsequently returned to its original position permitting retraction of connecting rod 42 of assembly 40, thus effecting movement of the segments 36 and 38 toward each other. This causes a nip to be presented between the applicator rolls 52 or each of the respective roll trains 18 and 20 with the web 56 therebetween. The nip pressures between the rolls in each of the roll trains 18 and 20 are next initially adjusted in order to assure a transverse tangential engagement therebetween, and the appropriate tinting fluid is placed in supply 106 therefor. (In practice, it is preferred to provide a separate supply 106 for each dying agent to minimize clean-up when changes in color are made.)

Web 56 is then caused to move through unit 10 and the entire press 120 which in turn drives the freely rotatable applicator rolls 52 in engagement therewith. As best shown in FIG. 3, web 56 moves in a generally downward direction through the nip formed between the respective applicator rolls 52, thus causing the latter, as well as the rolls in engagement therewith, to rotate in response to such web movement.

Simultaneously with movement of the respective web-driven rolls trains 18 and 20, tinting fluid is applied from dispensing heads 32 onto the underlying reception rolls 48 therefor. This only requires that pump 110 be activated in order to propel tinting fluid to manifold 100 and thence to the separate heads 32. In this connection, it has been found that a fluid pressure of approximately 2 pounds per square inch is in most cases optimum for conventional tinting fluids, with a total flow through the respective heads 32 being at a level of about two gallons per minute.

It is also to be understood that one or both sides of web 56 can be colored as desired. When it is necessary to tint only one side thereof, a knob 30 is manipulated to disengage roller contact with one side of web 56, for example, the rolls of train 18. This permits one-side tinting without undue wear on the rolls of train 18 which could occur if this latter train was operated without tinting fluid thereon during one-side tinting with train 20 (i.e., by turning dispensing heads 32 associated with train 18 to the non-tinting disposition thereof as depicted in phantom in FIG. 4, while allowing web 56 to drive both of the trains as in the normal tinting mode). In the exemplary one-side operation, the side of web 56 in contact with roll 52 of train 20 is colored, while the opposite side remains basic white. It will also be appreciated, however, that even amounts of tinting fluid are directed to each of the dispensing heads 32 on both sides of web 56 from common manifold 100, but on the non-colored side thereof, tinting fluid is simply collected and recirculated throughout the entire system on a continuous basis, along with any excess fluid from the coloration side of unit 10.

As tinting fluid from the heads 32 impinges upon the reception rolls 48 therebeneath, fluid is in turn transferred to resilient transfer rolls 50, and ultimately to resilient applicator rolls 52. At this point, the tinting fluid applied directly to the proximal face of moving web 56 is in rolling contact therewith.

Accurate metering and color control are provided in unit 10 through the use of the shiftable dispensing heads 32 and plate-like metering members 114. The latter are in spanning, tangential, tension engagement with each respective tinting fluid-receiving roll 48 as depicted, and through the use thereof it is possible to precisely meter the flow of tinting fluid therepast. Moreover, the metering members 114 permit setting of the heads 32 at a given position, whereupon the latter can be left unattended through relatively large variations of web speed which can occur during tinting operations. The yieldable nature of the metering members 114 allows varying quantities of tinting fluid to be applied to the transfer rolls 50 and in turn to web 56 during corresponding variations in the linear speed of the latter. Moreover, this is accomplished without the necessity of continual monitoring and manipulation of the heads 32, thus freeing the operator for other tasks and permitting more economical operation and maintenance of color quality.

Although the specific mode of operation of metering member 114 is not completely understood, it is believed that as the tinting fluid receiving rolls 48 move at greater rotational speeds by virtue of increasing forward web speed, greater amounts of tinting fluid impinge upon the underside of members 114, thereby causing the latter to lift or yield to a greater extent than would normally obtain. Such increasing hydraulic pressures as a consequence cause more tinting fluid to pass the tensioned junctures between metering members 114 and tinting fluid-receiving rolls 48, and thus onto transfer rolls 50. Hence, as forward web speeds increase, greater amounts of tinting fluid ultimately reach the applicator rolls 52 to be applied to the web. Similarly, at lesser web speeds more tinting fluid drips off the tinting fluid-receiving rolls 48 to be collected in tray structures 34, and lesser amounts of tinting fluid are permitted to pass beyond the junctures between metering members 114 and rolls 46. Therefore, at substantially all web speeds even up to 1000 feet per minute or more, it is possible to evenly and uniformly tint the moving web without fear of skippage or saturation thereof.

After initial operations are commenced with the tinting unit of this invention, it may be advisable to adjust the nip pressures between the various rolls in the roll trains in order to achieve optimum tinting. For this purpose, the adjustment means described above can be employed, and the unit restarted. Once optimum conditions have been obtained, it is generally not necessary to again adjust the overall unit to compensate for differences in fluid density, evaporative tendencies, and other differences in the make-up of different tinting fluids and atmospheric conditions.

However, if different paper width dictates adjustment of the heads to obtain uniform tinting fluid distribution, this is readily accomplished by rotating all or a part of the heads 32 as necessary.

Having thus described the invention, what is claimed as new and desired to be secured by Letters Patent is:

1. A web tinting unit, comprising:

at least one roll train having a number of elongated, rotatable rolls in tangential engagement along the lengths thereof and including an applicator roll at one end thereof and a tinting-fluid receiving roll at the opposite end thereof;

a plurality of spaced dispensing means disposed along the length of said tinting fluid receiving roll and proximal thereto for directing tinting fluid onto the periphery of the latter;

each of said dispensing means including a head having a tubular dispensing pipe in offset relationship to the geometric center thereof;

means mounting said heads for rotation thereof about respective axes for varying the amount of tinting fluid directed onto the periphery of the latter; and structure supporting said roll train and dispensing means in web-receiving and tinting disposition.

2. The tinting unit as set forth in claim 1 wherein said respective axes are generally perpendicular to the longitudinal axis of said fluid receiving rod.

3. The tinting unit as set forth in claim 1 including a common supply of tinting fluid for said separate dispensing heads, conduit means interconnecting said each of said dispensing heads and the common supply, said conduit means being of a diameter permitting substantially unrestricted fluid flow therethrough, there being low pressure pump means interposed in said conduit means for transferring said tinting fluid to said dispensing heads.

4. The tinting unit as set forth in claim 1 wherein is provided first and second roll trains each having a number of elongated, rotatable rolls in engagement along the lengths thereof and including an applicator roll at one end thereof, and a tinting fluid receiving roll at the opposite end thereof, said applicator rolls in said first and second roll trains being positioned in proximal alignment to cooperatively present a nip for said web.

5. The tinting unit as set forth in claim 4 wherein said rolls in each roll train are freely rotatable.

6. The tinting unit as set forth in claim 1, including a flexible, elongated, plate-like member spanning said tinting fluid receiving roll and in tensioned, tangential engagement therewith along the length thereof, said metering member engaging said tinting fluid receiving roll at a point on the latter between the area where tinting fluid impinges thereon and the nip presented by said tinting fluid receiving rolls and the adjacent roll of said train, said metering member being yieldable in response to the variable hydraulic pressure directed thereagainst during changing web speeds by the tinting fluid on said tinting fluid receiving roll to permit varying amounts of tinting fluid to be transferred to the remaining rolls of said train.

7. The tinting unit as set forth in claim 1 including means for individually and selectively rotating the respective dispensing means.

8. The tinting unit as set forth in claim 1 wherein each of said dispensing means is sized to permit substantially unrestricted flow of tinting fluid therethrough.

* * * * *